US011035534B2

(12) United States Patent
Li et al.

(10) Patent No.: US 11,035,534 B2
(45) Date of Patent: Jun. 15, 2021

(54) LUMINAIRE

(71) Applicant: SIGNIFY HOLDING B.V., Eindhoven (NL)

(72) Inventors: Qin Li, Eindhoven (NL); Wil Ma, Eindhoven (NL); Zhong Huang, Eindhoven (NL); Huajie Luo, Eindhoven (NL); Liang Zhou, Eindhoven (NL); Jing Bao, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 5 days.

(21) Appl. No.: 16/615,431

(22) PCT Filed: May 18, 2018

(86) PCT No.: PCT/EP2018/063133

§ 371 (c)(1),
(2) Date: Nov. 21, 2019

(87) PCT Pub. No.: WO2018/215345

PCT Pub. Date: Nov. 29, 2018

(65) Prior Publication Data

US 2020/0080692 A1 Mar. 12, 2020

(30) Foreign Application Priority Data

May 25, 2017 (WO) ..... PCT/CN2017/085914
Jul. 3, 2017 (EP) ..... 17179357

(51) Int. Cl.
*F21S 8/02* (2006.01)
*F21V 5/04* (2006.01)
(Continued)

(52) U.S. Cl.
CPC ..... *F21S 8/026* (2013.01); *F21V 5/046* (2013.01); *F21V 7/0091* (2013.01); *F21V 13/04* (2013.01);
(Continued)

(58) Field of Classification Search
CPC ..... F21S 8/026; F21V 5/046; F21V 7/0091; F21V 13/04; F21V 7/0008; F21Y 2103/33; F21Y 2215/10
(Continued)

(56) References Cited

U.S. PATENT DOCUMENTS 8,157,405 B1 * 4/2012 Schlanger ..... F21V 15/01 362/183
9,239,141 B1 1/2016 Schertler
(Continued)

FOREIGN PATENT DOCUMENTS

EP 1267116 A1 12/2002
EP 2278214 A1 1/2011
(Continued)

*Primary Examiner* — Andrew J Coughlin
*Assistant Examiner* — Jessica M Apenteng
(74) *Attorney, Agent, or Firm* — Daniel J. Piotrowski

(57) ABSTRACT

A luminaire has a light source carrier around a central light output window, with light sources facing a first, at least partially upward, direction. An upper reflector cover reflects light to a range of light output directions, at least partially downwardly, through the central window opening. A lens structure is formed over the set of light sources having a light diffusing output area and reflecting side walls extending between the light sources and the light diffusing output area. This design enables the luminaire to be very slim. The design may also avoid the need for a light diffusing output window.

15 Claims, 4 Drawing Sheets

(51) Int. Cl.

| | |
|---|---|
| ***F21V 7/00*** | (2006.01) |
| ***F21V 13/04*** | (2006.01) |
| ***F21Y 103/33*** | (2016.01) |
| ***F21Y 115/10*** | (2016.01) |

(52) U.S. Cl.
CPC ..... *F21Y 2103/33* (2016.08); *F21Y 2115/10* (2016.08)

(58) Field of Classification Search
USPC ..... 362/145
See application file for complete search history.

(56) References Cited

U.S. PATENT DOCUMENTS

| | | | | |
|---|---|---|---|---|
| 2005/0073848 | A1* | 4/2005 | King | F21S 8/026 362/296.02 |
| 2007/0263379 | A1 | 11/2007 | Dowling | |
| 2010/0027256 | A1 | 2/2010 | Kinoshita | |
| 2010/0237760 | A1* | 9/2010 | Yang | F21S 8/02 313/46 |
| 2010/0238658 | A1 | 9/2010 | Xiang et al. | |
| 2014/0063817 | A1* | 3/2014 | Bartenbach | F21V 7/0091 362/311.02 |
| 2014/0192555 | A1 | 7/2014 | Ye et al. | |
| 2015/0184827 | A1 | 7/2015 | Lin et al. | |
| 2015/0241023 | A1 | 8/2015 | Kim et al. | |
| 2016/0153705 | A1* | 6/2016 | Dubuc | F25D 23/028 312/405.1 |
| 2016/0370535 | A1* | 12/2016 | Boomgaarden | G02B 6/00 |
| 2017/0138565 | A1 | 5/2017 | Ko et al. | |

FOREIGN PATENT DOCUMENTS

| | | | |
|---|---|---|---|
| JP | 2006019160 | A | 1/2006 |
| KR | 2017138565 | A1 | 5/2017 |
| WO | 2013104556 | A1 | 7/2013 |

* cited by examiner

LUMINAIRE

CROSS-REFERENCE TO PRIOR APPLICATIONS

This application is the U.S. National Phase application under 35 U.S.C. § 371 of International Application No. PCT/EP2018/063133, filed on May 18, 2018, which claims the benefit of International Application No. PCT/CN2017/085914, filed on May 25, 2017 and European Patent Application No. 17179357.3, filed on Jul. 3, 2017. These applications are hereby incorporated by reference herein.

FIELD OF THE INVENTION

This invention relates to luminaires, in particular relates to luminaires which have a low height, such as slim downlights, and more particular relates to luminaires with replaceable light sources.

BACKGROUND OF THE INVENTION

There are many different types of downlight. Many designs are based on a recessed receiving chamber for receiving a bulb, which is then held in place by a push fit arrangement or a clip or by the design of the bulb electrical connection (such as a bayonet or screw fitting). The receiving chamber then for example forms a deep reflector to control the light output beam angle.

LED lighting panels having an array of LEDs instead of luminaires with individual discrete bulbs are increasingly popular. To make it possible to recess such lighting panels into a ceiling, or for an improved aesthetic appearance generally, luminaires in the form of slim lighting panels are popular in the market.

There are many different types of slim luminaire, including slim downlights, slim troffers, and slim ceiling-recessed lights.

One difficulty with slim lighting panels, and in particular using LEDs which function as small point sources, is that it is not easy to obtain good uniformity and low glare. Hence, slim luminaires are often used in situations which have low requirements on uniformity and glare.

Another issue particularly for LED lighting panels is that the light source in general cannot be replaced when it is broken. The LEDs are formed on an integrated circuit which becomes an integral part of the luminaire. End users have to replace the complete luminaire instead, which leads to increased cost.

There is therefore a need for a luminaire design which enables the light source to be replaced, and which enables a slim luminaire design with good control of the output light uniformity and glare.

SUMMARY OF THE INVENTION

According to examples in accordance with an aspect of the invention, there is provided a luminaire comprising:

a light source carrier having a central opening;

a set of light sources mounted on the carrier facing a first direction;

a reflector cover over the light source carrier and extending across the central opening, adapted to reflect light to a range of light output directions through the central opening, including a direction opposite to the first direction; and a lens structure formed over the set of light sources, comprising:

a light diffusing output area which faces partly inwardly towards a center of the central opening and partly in the first direction towards the reflector cover; and reflecting side walls extending between the set of light sources and the light diffusing output area.

Thus, a slim luminaire is enabled, for example for recessed fitting into a ceiling. The height of the luminaire is for example less than 25 mm, for example less than 20 mm and may even be 15 mm or less. The lens structure performs a diffusion function, and this may in some examples avoid the need for a further light diffusing output window. The output from the light diffusing output area is directed inwardly, so as to provide illumination from the full area of the central opening, and also upwardly (when the luminaire is mounted to create downward illumination) so as to prevent direct visibility of the light sources and hence reduce spottiness. The central opening forms the light output window of the luminaire.

In a preferable embodiment, the light source carrier with its mounted set of light sources is separable from the reflector to enable replacement. This design provides a replaceable light source arrangement for a luminaire, but without requiring significant additional depth of the luminaire. The separation of the light source carrier may remove the lens structure as well which is then attached to the light source carrier, or else the lens structure may remain attached to the reflector cover.

The reflecting side walls may comprise a first, total internal reflection, side wall extending between the set of light sources and a first edge of the light diffusing output area remote from the reflector cover and a second, mirror reflective, side wall extending between the set of light sources and a second edge of the light diffusing output area close to the reflector cover.

The two side walls mean that there are multiple different light paths to the light diffusing output area and the design can be tuned to achieve a desired uniformity of the light output. The use of a total internal reflection side wall is possible because of the low thickness of the luminaire, in that this side wall is relatively flat and hence receives light from the light source at large angles of incidence.

The luminaire may comprise a reflective coating on the outside of the lens structure to form the mirror reflective side wall.

The mirror reflective side wall for example comprises a parabolic reflector. A parabolic reflector is simple to design, with all light rays extending between the focus point and parallel output lines. Other reflector shapes are of course possible such as Bezier curves.

The lens structure is for example formed of a clear plastic. It can thus be formed as a low-cost molded component.

The lens structure may comprise a separate lens portion associated with each light source.

This may simplify the manufacture of the lens structure. For example, the lens may be formed by extruding a long lens bar with the same cross-section, then cutting it into short segments to form the separate lens portions. Many line segments can approximate a circle.

The diffusing output area for example comprises a microstructured ridge surface. This is easy to form, for example as part of a molding or extrusion process.

The ridges of the ridge surface for example each extend in a respective plane parallel to the light source carrier. The ridges thus form rings (continuous or discontinuous) around the annular shape. In this way, the diffusion is primarily in the up-down direction, which ensures that some light is directed across the full width of the central opening, thereby ensuring a light output from the center of the luminaire.

The reflector cover may comprise a micro-structured reflecting surface. This provides an additional diffusion function (but with low light loss) before light exits the central opening of the annular light source carrier. There may for example be a regular or random pattern of structures on the lower surface, such as embossments, dimples or prisms.

The central opening may comprise a clear window. Thus, no output diffuser is needed, hence reducing the cost of the luminaire. The light sources for example comprise LEDs.

The light sources may be distributed uniformly around the annular light source carrier. This provides a rotationally symmetric annular light output distribution. The light source carrier is for example circular. It may comprise a heat sink portion for dissipating heat from the light sources.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a luminaire having a light source carrier around a central light output window, with light sources facing a first, at least partially upward, direction. An upper reflector cover reflects light to a range of light output directions, at least partially downwardly, through the central window opening. A lens structure is formed over the set of light sources having a light diffusing output area and reflecting side walls extending between the light sources and the light diffusing output area. The light source carrier with its mounted set of light sources is separable from the reflector to enable replacement. This design enables light source replacement without requiring significant additional depth of the luminaire. The design may also avoid the need for a light diffusing output window.

Figure 1:
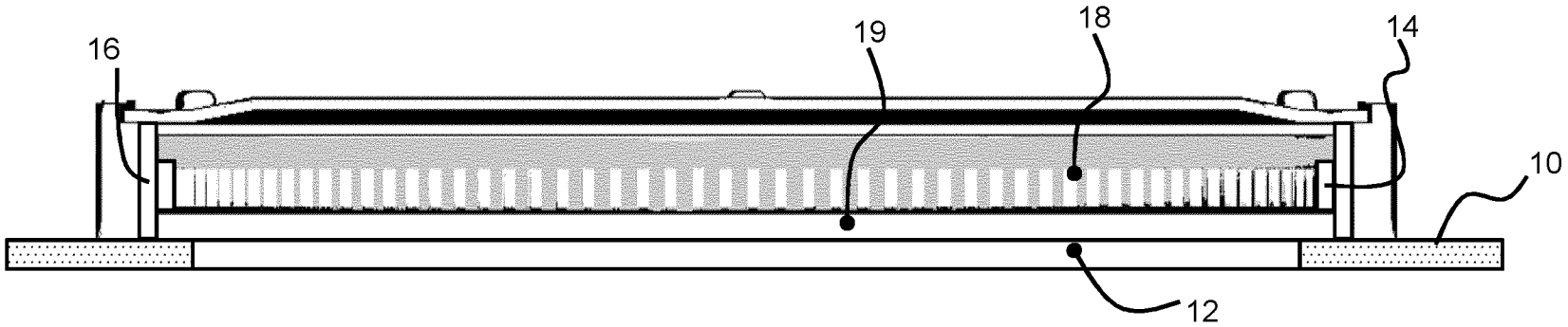
FIG. 1 shows a known luminaire design.

FIG. 1 shows a known slim luminaire design. The luminaire comprises a housing 10 which defines the lower surface of the luminaire, in which there is a light output window 12. The light source comprises a ring of LEDs 14 carried on a support 16. The LEDs provide their light output into a light guide 18 having an upper reflective film and a diffuser 19 on the lower light output face.

The luminaire thus has a sandwich structure of the upper reflective film, the light guide and the diffuser at bottom. This design can be slim and the light output can be uniform when the luminaire has a small size. However, it is hard to control the beam angle as a result of the diffuser at the front window. This diffuser is needed to avoid spottiness. This solution is thus not suitable for some luminaire designs with particular requirements on the light output characteristics.

Figure 2:
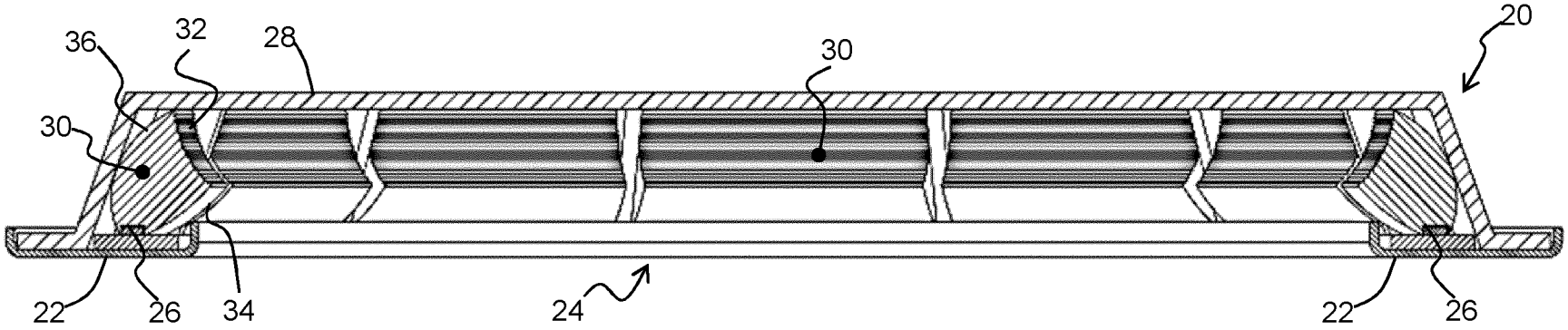
FIG. 2 shows a luminaire design in accordance with an example of the invention.

FIG. 2 shows an example of a luminaire 20, in accordance with the invention in cross section. The luminaire comprises a light source carrier 22 having a central opening 24. This defines the light output window of the luminaire, and may for example be flush with a ceiling or it may define the bottom face of a suspended luminaire.

A set of light sources, in particular LEDs 26, is mounted on the carrier 22 facing a first direction. This first direction is generally upwardly, i.e. opposite to the central optical axis of the output light through the central opening 24, which is generally downwardly.

A reflector cover 28 is provided over the annular light source carrier 22 and extends across the central opening 24. Preferably, the reflector cover 28 is parallel to a light output window delimited by the central opening 24. The reflector cover 28 reflects light to a range of light output directions through the central opening 24, centered around the central optical axis.

A lens structure 30 is formed over the set of LEDs 26 and directs the light from the LEDs to the reflector cover 28. In the example shown, the lens structure comprises a set of discrete lens elements arranged in an annular path around the central opening 24 (which may be circular or non-circular). Each lens element may be associated with an individual LED 26 or a group of LED which form a subset of the full set of LEDs 26.

The lens elements each comprise a light diffusing output area 32 which faces partly inwardly towards a center of the central opening 24 and partly in the first (upward) direction towards the reflector cover 28. Thus, they illuminate the reflector cover with diffuse light, and they are inclined so that light reaches the diffuser cover above the center of the central opening 24.

The lens elements each also comprise reflecting side walls 34, 36 extending between the LED 26 and the light diffusing output area 32. Thus, all or nearly all LED output light is directed towards the diffusing output area.

The light source carrier 22 with its mounted set of LEDs 26 is separable from the reflector to enable replacement.

The lens design means that a slim luminaire is enabled, because it redirects light from the upward direction to a partially inward direction. Because the initial light output direction is upwardly, the LEDs are not directly visible from below the luminaire. It also means a replaceable light source design is easy to implement, because the light source carrier 22 can simply be pushed into place.

The height of the luminaire is for example less than 25 mm, for example less than 20 mm and may even be 15 mm or less.

The central opening 24 may be a clear opening without the need for a further diffuser. It preferably has a clear cover to protect the internal components of the luminaire.

The replacement of the light source involves removing the carrier 22 and the LEDs 26. The lens structure may be part of the removable unit or else the lens structure may remain attached to the reflector which forms the housing of the luminaire. The carrier 22 may be a snap fit to the cover 28 or there may be any suitable design of attachment feature such as hooks, magnets or screws.

The connection between the light source carrier 22 and the reflector 28 (which forms the main housing of the luminaire) also implements an electrical connection to the light source arrangement. Thus, a push fit electrical connector may be provided which is engaged when the light source carrier is fitted into place. Alternatively, there may be a separate connector so that after the light source carrier is unclipped, a series electrical connector must also be detached to fully release the light source carrier from the reflector. The electrical connection will then need to be made before fitting the light source carrier to the reflector. Numerous possibilities will be apparent to those skilled in the art.

Figure 3:
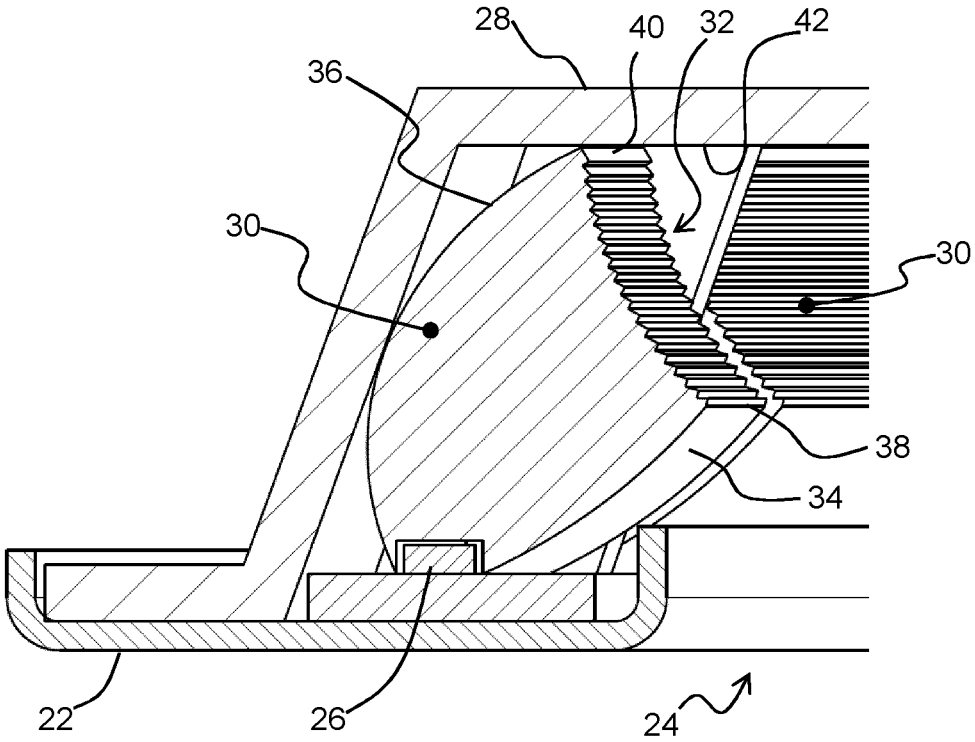
FIG. 3 shows a part of the design of FIG. 2 in more detail.

FIG. 3 shows one of the lens elements 30 in more detail. The reflecting side walls comprise a first, total internal reflection, side wall 34 which extends between the LED 26 and a first edge 38 of the light diffusing output area 32. This first edge is on the downward side of the lens element, i.e. remote from the reflector cover 28.

As this is the lower part of the lens element and is relatively flat (in order to obtain a slim design), the light from the LED 26 has a large angle of incidence to the surface of the side wall 34 and hence reflection is by total internal reflection. This avoids the need for any reflecting coating.

The reflecting side walls comprise a second, mirror reflective, side wall 36 extending between the LED 26 and a second edge 40 of the light diffusing output area 32. This second edge is on the upward side of the lens element, i.e. close to the reflector cover 28. As this is the upper part of the lens element and is relatively steep, some of the light from the LED 26 will have a small angle of incidence to the surface of the side wall 36 and hence a reflection coating is provided, for example by plasma vapor deposition.

The two side walls and the light diffusing output area are designed to achieve a desired uniformity of the light output.

The mirror reflective side wall 36 is the main reflector since it receives most of the light output from the LED 26 (which has a Lambertian output intensity). It may comprise a parabolic reflector which is simple to design.

The lens elements of the lens structure 30 are for example formed of a clear plastic such as PMMA or polycarbonate. They may be molded or extruded. Extruded lens elements will have a length which is sufficiently short that multiple straight sections may be used around an annular path. These short straight sections may be formed by extruding a very long lens bar with a constant cross-section, then cutting it into short segments to form the separate individual lens elements 30.

The diffusing output area 32 may comprise a microstructured ridge surface as can be seen in FIG. 2. This is easy to form, for example as part of a molding or extrusion process. In particular, the ridges of the ridge surface may each extend in a respective plane parallel to the light source carrier 22. In other words, they extend along the length of the lens element 30, where the length is defined as the circumferential direction, i.e. the local tangential direction to the shape of the central opening 24. The ridges thus form rings (continuous for a one-piece lens design or discontinuous for a multiple lens element design) around the annular shape. The diffusion is primarily in the up-down direction, which ensures that light is directed across the full width of the central opening, thereby ensuring a light output from the center of the luminaire.

The reflector cover 28 has a lower surface 42 facing the central opening 24 and this may also comprise a microstructured reflecting surface. This provides an additional diffusion function before light exits the central opening of the annular light source carrier. There may for example be a regular or random pattern of structures on the lower surface 42, such as embossments, dimples or prisms.

Figure 4:
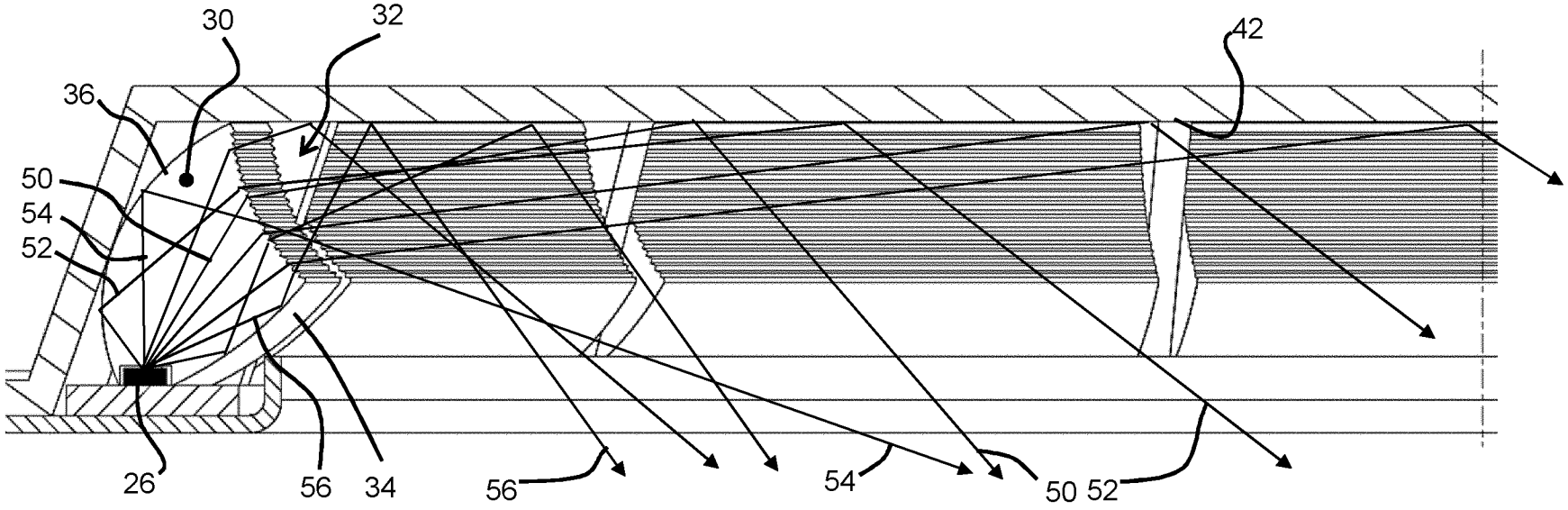
FIG. 4 shows light paths through the design of FIG. 2.

FIG. 4 shows the luminaire with light paths to illustrate the different functions.

After light enters the lens element 30 from the LED 26, there three main ray paths.

Some of light passes directly through the light diffusing output area 32. After diffusion, the light reaches the lower surface 42 of the reflector. The design is such that much of the light can reach the center to ensure the light intensity at the center. Ray path 50 is an example.

Some of light reaches the mirror reflection surface 36. Only after reflection, the light passes through the light diffusing output area 32. Some light reaches the lower surface 42 of the reflector (ray path 52) and other light comes out directly (ray path 54).

Some of the light is totally internal reflected by the surface 34 and then passes through the light diffusing output area 32 (ray path 56).

By suitable design of all of these light contributions, light is designed to be directed into the main volume of the luminaire from the lens elements uniformly. This gives low glare because the housing (in particular the reflector 28) and the lens structure are designed together to control the beam angle.

The luminaire may be made slimmer than traditional downlights because in order to achieve a similar uniformity, traditional downlights usually require a thick optical chamber. This design shown may have a thickness of only 15 mm.

The light output surface of the light diffusing output area 32 faces partially upwardly, so that light will not enter the eyes of room occupants, even from a large distance. This means that spottiness is avoided even there is no diffuser. Avoiding the need for a diffuser enables improved light efficiency as light efficiency drops by around 10 to 20% when light passes through a diffuser.

Figure 5:
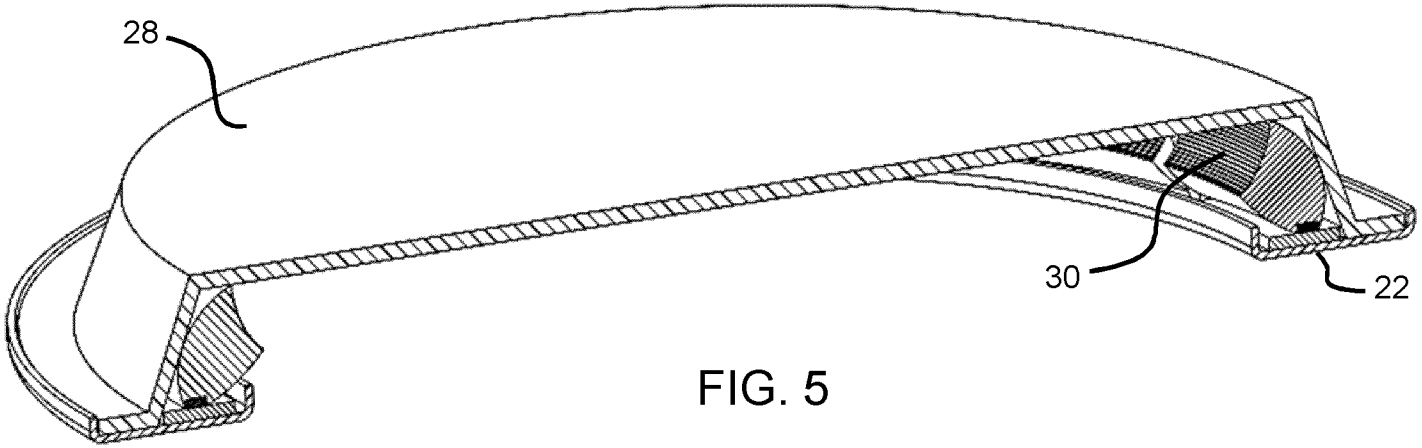
FIG. 5 shows the design of FIG. 2 in cut away perspective view.

For completeness, FIG. 5 shows a perspective but cut away view of the luminaire.

Figure 6:
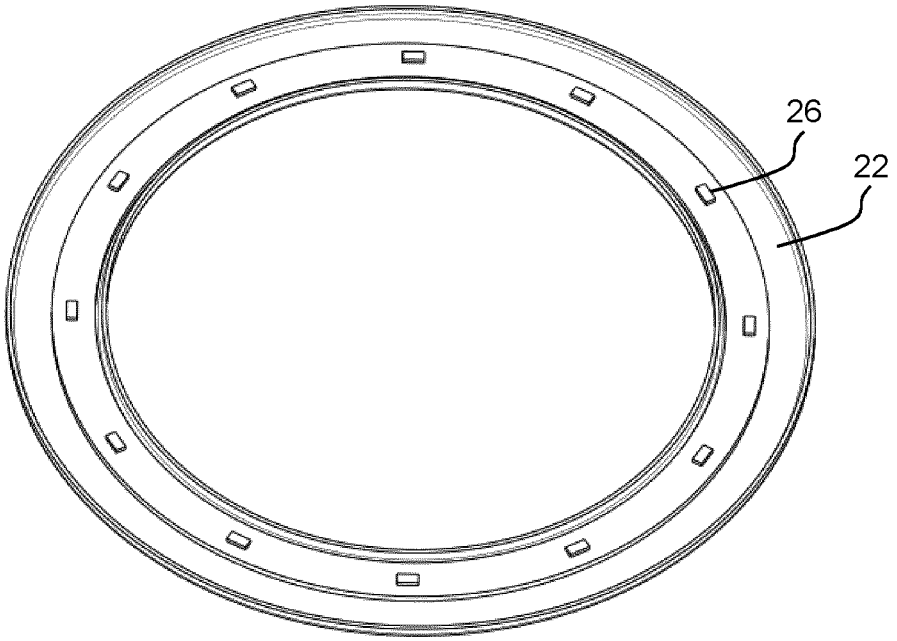
FIG. 6 shows the replaceable light source carrier.

FIG. 6 shows the replaceable light source carrier 22 with the mounted LEDs 26. The LEDs may have different flux or color temperature. They may have tunable output color such as tunable white, or indeed fully controllable RGB output color. The light source arrangement and carrier may for example be changeable to provide different lighting effects. Thus, a modular system may be formed with one design of housing and reflector and multiple designs of light source. The LEDs 26 are for example distributed uniformly around the light source carrier 22. The light source carrier may further include a heat sink portion, which may be a separate component carried by the carrier or it may be defined by the material of the carrier itself.

Figure 7:
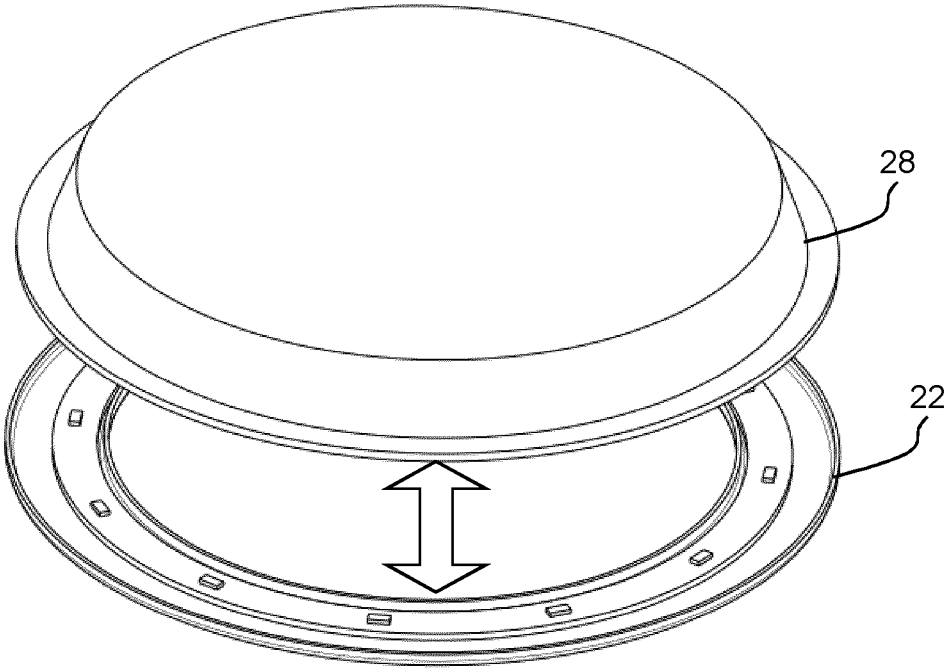
FIG. 7 shows how the coupling between the replaceable light source carrier and the reflector takes place.

FIG. 7 shows the positional relationship between the reflector 28 and the light source carrier 22 during mounting and dismounting.

The invention enables a slim design but with good uniformity, low glare and a narrow beam angle. There is high optical efficiency in that the light passes mainly through total internal reflection and mirror reflection, with no need for a general diffuser function. The light source arrangement is easily replaced by an end user either when the light source is broken or simply to implement a different lighting effect.

The invention may be applied to ceiling luminaires, troffers or downlights

There may be any number of LED around the carrier, for example from 4 to 100. The concept of the invention is also not limited to LEDs, although it is in general of particular interest for small size light sources which give a spotty appearance when viewed directly.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A luminaire comprising:

a light source carrier having a central opening;

a set of light sources mounted on the carrier facing a first direction;

a reflector cover over the light source carrier and extending across the central opening, adapted to reflect light to a range of light output directions through the central opening, including a direction opposite to the first direction; and a lens structure formed over the set of light sources, comprising:

a light diffusing output area which faces partly inwardly towards a center of the central opening and partly in the first direction towards the reflector cover; and reflecting side walls extending between the set of light sources and the light diffusing output area.

2. A luminaire as claimed in claim 1, wherein the light source carrier with its mounted set of light sources is separable from the reflector to enable replacement.

3. A luminaire as claimed in claim 1, wherein the reflecting side walls comprise a first, total internal reflection, side wall extending between the set of light sources and a first edge of the light diffusing output area remote from the reflector cover and a second, mirror reflective, side wall extending between the set of light sources and a second edge of the light diffusing output area close to the reflector cover.

4. A luminaire as claimed in claim 1, comprising a reflective coating on the outside of the lens structure to form the mirror reflective side wall.

5. A luminaire as claimed in claim 1, wherein the mirror reflective side wall comprises a parabolic reflector.

6. A luminaire as claimed in claim 1, wherein the lens structure is formed of a clear plastic.

7. A luminaire as claimed in claim 1, wherein the lens structure comprises a separate lens portion associated with each light source.

8. A luminaire as claimed in claim 1, wherein the diffusing output area comprises a micro-structured ridge surface.

9. A luminaire as claimed in claim 8, wherein the ridges of the ridge surface each extend in a respective plane parallel to the light source carrier.

10. A luminaire as claimed in claim 1, wherein the reflector cover comprises a micro-structured reflecting surface.

11. A luminaire as claimed in claim 1, wherein the central opening comprises a clear window.

12. A luminaire as claimed in claim 1, wherein the light sources comprise LEDs.

13. A luminaire as claimed in claim 1, wherein the light sources are distributed uniformly around the light source carrier.

14. A luminaire as claimed in claim 1, wherein the light source carrier is circular.

15. A luminaire as claimed in claim 1, wherein the light source carrier comprises a heat sink portion.

* * * * *